United States Patent [19]

Montoya

[11] 4,180,275

[45] Dec. 25, 1979

[54] SKI ATTACHMENT

[76] Inventor: Allan Montoya, 345 W. 58th St. #5M, New York, N.Y. 10019

[21] Appl. No.: 934,274

[22] Filed: Aug. 16, 1978

[51] Int. Cl.[2] ..... A63C 11/00

[52] U.S. Cl. ..... 280/11.37 E; 280/28; 280/609

[58] Field of Search ..... 280/11.37 E, 11.37 J, 280/11.37 R, 601, 603, 609, 28

[56] References Cited

U.S. PATENT DOCUMENTS

| | | | |
|---|---|---|---|
| 3,482,849 | 12/1969 | Puetz | 280/28 |
| 3,501,160 | 3/1970 | Lange | 280/609 |

FOREIGN PATENT DOCUMENTS

| | | | |
|---|---|---|---|
| 125269 | 11/1931 | Austria | 280/11.37 R |
| 587723 | 1/1959 | Italy | 280/601 |
| 39329 | 7/1924 | Norway | 280/601 |
| 88924 | 3/1937 | Sweden | 280/601 |

*Primary Examiner*—David M. Mitchell
*Attorney, Agent, or Firm*—John E. Benoit

[57] ABSTRACT

A removable ski extender for attachment to a ski tip is provided which comprises an arcuate snowfoil curved at one end thereof, an arcuate platform secured to the other end thereof and extending above said snowfoil and in the direction of said curved end, said platform having substantially the same curvature as said ski tip, lips attached to said arcuate platform for retainably mating with the edges of said ski tip, a bridge extending laterally across said other end of said snowfoil, and a securing device in said bridge for removably securing said ski tip to said arcuate platform.

5 Claims, 4 Drawing Figures

SKI ATTACHMENT

This application relates generally to an attachment for a snow ski and more particularly to a ski extender attachment which adds additional length to the ski at the tip thereof.

The vast majority of skis produced today are for so-called "piste," or packed slope, skiing. They are designed to be quite stiff for good edge control, and generally come in compact to mid-length for good maneuverability. For the average skier, the compact to mid-length is decidedly easier to maneuver than the longer, 195 cm plus length.

In powder snow, however, the compact to mid-length ski has a marked tendency to dive or sink below the surface because of its short, stiff configuration. The result is to sharply restrict the skier's ability to perform turns and complete successful powder ski runs. This driving or sinking phenomenon is especially apparent among novice skiers lacking expertise in powder snow techniques developed to force ski tips above the powder snow surface. The invention described herein is designed to compensate for the driving and sinking effects of powder that result from the combination of compact-ski use and skier inexperience. It will also improve the performance of the experienced skier employing longer skis designed especially for powder snow conditions.

The lift resulting from snow pressure on the ski tip produces usable flex action in the body of a ski, generally designed into the middle of the ski. The present invention, by maximizing lift forces at the tip, thereby maximizes flex action in the ski.

The combination of strong lift and flex forces in a ski helps to assure stable flotation as the skier negotiates transitions from soft surfaces to harder or denser surfaces, and vice versa. The transition to softer surfaces, such as powder snow, is eased through the lift action of the present invention. Transitions to harder surfaces are softened through flex action.

Since the present invention brings the skis to the powder surface faster, allowing tighter and quicker turns, another result is less muscle burden on knees and thighs in executing these maneuvers. This ultimately translates into extra ski runs per day.

Further, the present invention, when added to skis, allows uninterrupted movement from powder to piste with edge control unhindered. Nor does it present problems "bashing" through the bumps or in riding the ski tows.

These and other objects of the invention will be more clearly understood from the following description taken together with the drawings.

In the following description, the base of the invention will be termed a snowfoil. This term is defined herein as referring to an elongated plate-like structure having a smooth continuous bottom surface which is basically planar, or substantially flat, across the transverse direction of the bottom and is arcuate along the longitudinal direction of the structure.

Figure 2:
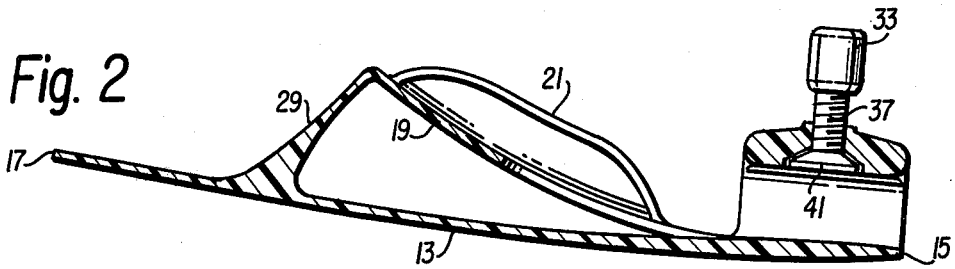
FIG. 2 is a sectional view taken along the lines 2—2 of FIG. 1.

Turning more specifically to the drawings, a ski extender 11 is comprised of a snowfoll 13 which terminates at its rearward edge in a substantially right angle edge 15 and at its forward edge in a rounded end 17. The snowfoil 13 has a substantially smooth undersurface and is arcuate in its longitudinal length as indicated more clearly in FIG. 2.

Figure 1:
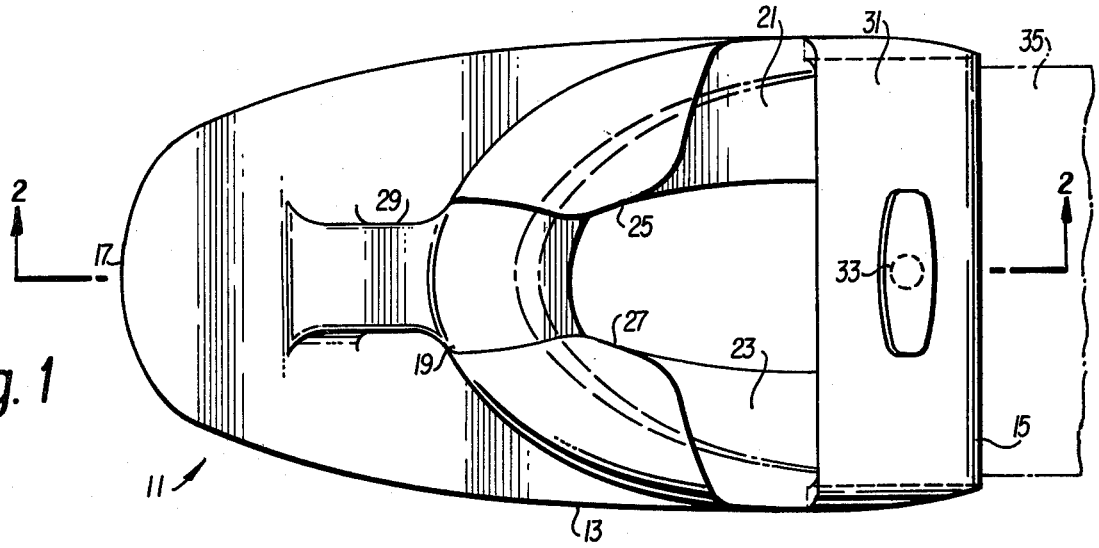
FIG. 1 is a plan view of one embodiment of the ski extender of the present invention.

An arcuate platform 21 extends upwardly and forwardly from the rear edge 15 of snowfoil 13. This platform is basically made from two legs 21 and 23 which join at the forward end thereof. Lips 25 and 27 extend upwardly from the legs and are so designed as to establish a mating and retaining contact with the tip of ski 35, shown in phantom lines in FIG. 1 and in solid lines in FIG. 3. In order to give structural support to the arcuate platform 19, a leg 29 extends from the upper side of the snowfoil 13 to the forward edge of platform 19.

Figure 3:
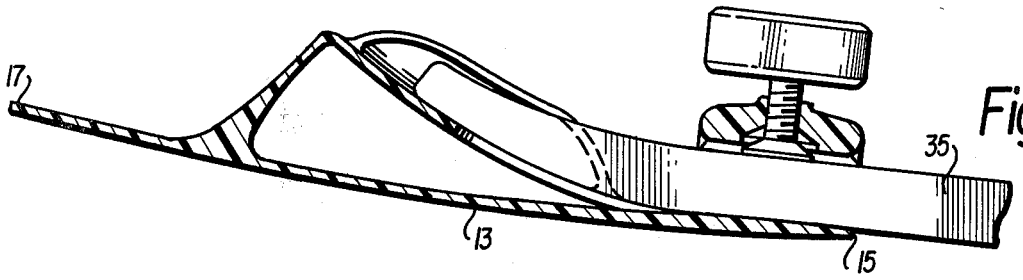
FIG. 3 is the same sectional view as FIG. 2 with a ski tip being inserted and clamped thereto.

In order to maintain the ski tip in place inside the lips and on the arcuate platform, bridge 31 extends above the rearward end of the snowfoil to a height sufficient to allow the ski tip to pass therethrough and onto the platform. Further, means are provided for maintaining the ski in solid contact against the arcuate platform and preventing relative movement thereof between the two. One such means is disclosed in FIGS. 1 and 2 as a winged bolt head 33 for manually adjusting a bolt 37 on which a bearing plate 41 is rotatably secured. As will be obvious from the showing in FIG. 3, the threading of the bolt 37 through the bridge 31, until it meets and firmly secures the ski against the arcuate platform, will provide the joining of the ski and the ski extender as indicated in FIG. 3.

Figure 4:
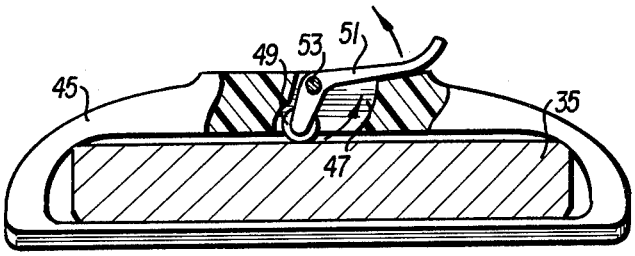
FIG. 4 is a cross-sectional view of a modified type of securing arrangement.

Another form of securing the ski to the ski platform is shown in FIG. 4. In that configuration, a slot 47 is formed in the bridge having a configuration as is shown, and a camming wheel 49, made of some resilient type of material to avoid damage to the ski, is controlled by means of an over-center cam actuator 51 extending outwardly from the bridge and mounted on pivot pin 33. When actuator 51 is rotated in the direction of the arrows, the cam will pass over-center and upwardly as indicated by the other arrow so as to free the ski. When the ski is in place, the actuator is rotated clockwise to move cam 49 to the position as shown in FIG. 4.

The ski extender as illustrated in the various drawings is preferably molded from a plastic or metal material in a unitary piece structure.

The preferable length of the product is from 11.5 to 30 centimeters since it is designed primarily for the moderate skier interested in trying powder snow and who is not accustomed to the handling characteristics of the long or flexible powder snow ski. A product longer than 12 inches could possibly create the very problem of handling which a new pair of powder snow skis would create for such a moderate skier.

The snowfoil itself is substantially about one-eighth of an inch in thickness and extends forwardly in a gently rising curve starting at the same point as the platform supporting the ski tip. The two platforms are tapered as shown both on the underside thereof and on the edge where the ski extender meets the ski so as not to add effective width to the ski tip platform itself.

The rise of the snowfoil platform is much less severe than that of the ski tip platform as will be obvious from the drawings. Consequently, the two platforms diverge progressively from the point of contact, requiring the support member as shown. The snowfoil preferably extends about 3 inches beyond the end of the ski tip platform. However, this is not to be considered an exact limitation since variations will occur depending on the usage. As a matter of act, if an expert skier should decide to temporarily change his compact skis into powder skis, he might prefer that a longer ski extender be used.

The above description and drawings are illustrative only since variations could be made in the ski extender without departing from the intent of the invention, and certain components could be substituted with equivalent components and still serve the same purpose. Accordingly, the invention is to be limited only by the scope of the following claims.

I claim:

1. A removable ski extender for attachment to a ski tip comprising an arcuate snowfoil curved at one end thereof;

an arcuate platform secured to the other end thereof and extending above said snowfoil and in the direction of said curved end, said platform having substantially the same curvature as said ski tip;

means attached to said arcuate platform for retainably mating with the edges of said ski tip;

a bridge extending laterally across said other end of said snowfoil; and means in said bridge for removably securing said ski tip to said arcuate platform.

2. The ski extender of claim 1 wherein said means in said bridge comprises:

a threaded both extending through said bridge; and a bearing surface at the bottom of said bolt.

3. The ski extender of claim 1 wherein said means in said bridge comprises a cam rotatably secured in said bridge; and a lever extending from said cam above said bridge for manually securing said cam against the upper side of said ski tip.

4. The ski extender of claim 1 wherein said snowfoil, platform, means attached to said platform, and bridge are of a unitary structure.

5. The ski extender of claim 1 wherein the length thereof is between 11.5 and 30 centimeters.

* * * * *